US005733423A

United States Patent [19]

Caspelherr

[11] Patent Number: 5,733,423

[45] Date of Patent: Mar. 31, 1998

[54] DEVICE FOR SEPARATION OF CAST THIMBLES FROM ANODE BARS

[75] Inventor: Heinz Caspelherr, Köln, Germany

[73] Assignee: Deutz, AG, Cologne, Germany

[21] Appl. No.: 679,419

[22] Filed: Jul. 8, 1996

[30] Foreign Application Priority Data

Jul. 15, 1995 [DE] Germany ..... 195 25 797 .9

[51] Int. Cl.[6] ..... C25C 3/12

[52] U.S. Cl. ..... 204/279; 204/294

[58] Field of Search ..... 204/243 R, 247, 204/225, 294, 279

[56] References Cited

U.S. PATENT DOCUMENTS

| | | | |
|---|---|---|---|
| 3,960,694 | 6/1976 | Champion et al. | 204/225 X |
| 4,217,197 | 8/1980 | Harder et al. | 204/243 R |
| 4,701,249 | 10/1987 | Wisniewski et al. | 204/279 |
| 4,855,031 | 8/1989 | Zannini | 204/245 X |
| 5,268,083 | 12/1993 | Rathgeber et al. | 204/245 X |

FOREIGN PATENT DOCUMENTS 44 14 271 10/1995 Germany .

OTHER PUBLICATIONS

KHD Humboldt Wedag AG Brochure No. 10–711e, "Thimble Removable Presses", Jun. 1989.

*Primary Examiner*—Donald R. Valentine

*Attorney, Agent, or Firm*—Hardaway Law Firm, P.A.; Charles L. Schwab

[57] ABSTRACT

A device for removing thimbles from the bottom ends of reprocessed anode bars. At least one externally toothed hollow shaft (12, 13) with a clamp ring is rotatably supported in a housing (10). Upon the hollow shaft being raised, a clamping ring engages a thimble. The external teeth of the hollow shaft are engaged by the teeth of a gear rack component of a double acting hydraulic piston whereby the thimble is twisted off the end of the anode bar.

6 Claims, 3 Drawing Sheets

10
11
12
13
14
15
16
17
18
19
I
II

DEVICE FOR SEPARATION OF CAST THIMBLES FROM ANODE BARS

TECHNICAL FIELD

This invention relates to a device for the separation of cast thimbles from anode bars, particularly anode bars which originate from fused-salt electrolysis of aluminum which are returned for reprocessing. The cast shells adhering to the bottom ends of yoke shaped anode bars are removed from the anode bar ends by an external force.

BACKGROUND OF THE INVENTION

Metallic aluminum is extracted from alumina by means of fused-salt electrolysis in electrolytic cells in which anodes in the form of carbon blocks are suspended.

In the preparation of anode blocks for their use in fused-salt electrolysis, the anode blocks must be rigidly attached to current-carrying bars which are referred to as anode bars. The anode bars are commonly formed as a yoke with the number and arrangement of anode bar ends of the yoke being chosen with due consideration being given to the size and weight of the anode block and the electric current distribution. The bottom ends of the anode bars are inserted from above into appropriately performed recesses of the anode block, and the remaining interstices or voids in the recesses are then filled by pouring in liquid iron. Cast shells or thimbles thus form around the anode bar ends, which cast thimbles effect both mechanical strength of the connection between anode bar and block anode and also good electrical conductance from the anode bar into the block anode. After the cast metal has solidified, an adhesive connection arises between the cast thimble and the anode bar end as well as between the cast thimble and the anode block.

When properly used, the anodes cannot be completely burned down to the cast thimbles. After their use in fused-salt electrolysis, the anode residues as well as adhering bath material are removed from the cast thimbles. Then the cast thimbles remaining on the yoke of the anode bars are removed from the anode bar ends by means of a hydraulically actuated cast thimble removing press such as shown in Brochure No. 10-711 e of KHD Humboldt Wedag AG.

In German Patent Document P44 14 271.4, it is proposed, in order to facilitate the removal of the cast thimbles from the anode bar ends, that the cast thimbles not be removed or broken off by means of linear movement of a tool but, rather, that the cast thimbles be removed by means of rotation in order to sever the adhesive connection between the anode bar ends and the cast thimbles, with a torsional moment being applied while the anode bars are held in a fixed position.

OBJECT AND SUMMARY OF THE INVENTION

It is an object of the present invention to create an improved device for the removal, in particular twisting off, of cast thimbles from their anode bar ends, which device is simply designed in terms of driving and is reliable in operation.

The device of this invention for removal or twisting off of cast thimbles from their anode bar ends has a housing, in which at least one externally toothed hollow shaft having a clamp ring is rotatably supported. The housing is raised by a lift to the anode bar end having the thimble, which is held in a fixed position, and the clamp ring protruding upward from the housing is mechanically slid upwardly onto the cast thimble to be removed. The hollow rotatable shaft has external teeth engaged with a toothed rack of a double-acting hydraulic cylinder. A part of the housing of the device is formed by a hydraulic piston-cylinder unit. The hydraulic piston is displaceable by means of pressurization, and thus the hollow shaft with clamp ring as well as the cast thimble is rotated to break the adhesive connection of the spindle to the bar end. The externally toothed hollow shaft may be toothed a full 360°. With this rotary drive, large torsional moments can also be transmitted by the clamp ring to the cast thimble being removed, so that the cast thimbles, even if very firmly seated, can be twisted off their anode bar ends in an-operationally reliable and simple manner with the application of a comparatively slight force. If the cast thimbles to be removed are very firmly seated, the cast thimbles can be rotated back and forth by means of alternating pressurization of the toothed rack hydraulic piston.

The externally toothed hollow shaft rotatably supported in the housing can be of one piece with the clamp ring that is slidable onto the cast thimble being removed. The clamp ring and externally toothed hollow shaft can, however, also be of two pieces with the clamp ring rigidly fastened by screws to the upper end face of the hollow shaft. In this way, the clamp ring forms an easily interchanged replacement part, and different clamp rings having different diameters can also be fastened to the externally toothed hollow shaft for the purpose of adaptation to the outside diameter of the cast thimbles being removed.

The device of this invention may be constructed to simultaneously remove a plurality of cast thimbles from their anode bar ends. In such a device at least two hollow shafts are rotatably supported next to each other with their external teeth engaged by a toothed rack driven by a hydraulic piston. Thus, two or more externally toothed hollow shafts can be rotatably supported parallel to each other in so-called tandem arrangement in a common housing and can be engaged with the toothed rack gear of a double-acting hydraulic piston. The double-acting hydraulic piston can include a rack gear with teeth on opposite sides of the rack, the toothed rack being engaged with the external teeth of hollow shafts positioned on opposite sides of the hydraulic piston. Such a device can be used to remove thimbles from anode bar yokes whose bar ends define triangles or quadrilaterals, and thus it is possible to twist three or four cast thimbles off the anode bar ends simultaneously.

Two double-acting hydraulic pistons with rack gears can also be positioned parallel to each other and a distance apart in so-called twin arrangement in a common housing. The toothed sides of the racks of the two hydraulic pistons facing each other and with a plurality of parallel, externally toothed hollow shafts therebetween. By actuation of the two twin hydraulic pistons arranged parallel to each other, the externally toothed hollow shafts with clamp rings, together with respective cast shells are rotated with particularly high torque and, if necessary, can be rotated back and forth. For their synchronized actuation, the twin hydraulic pistons of the respective double-acting hydraulic cylinders can be connected to a hydraulic system having a single hydraulic pump.

BRIEF DESCRIPTION OF THE DRAWINGS

The invention and its further features and advantages are hereinafter described in detail by reference to the drawings in which.

DETAILED DESCRIPTION OF THE DRAWINGS

Figures 1, 2:
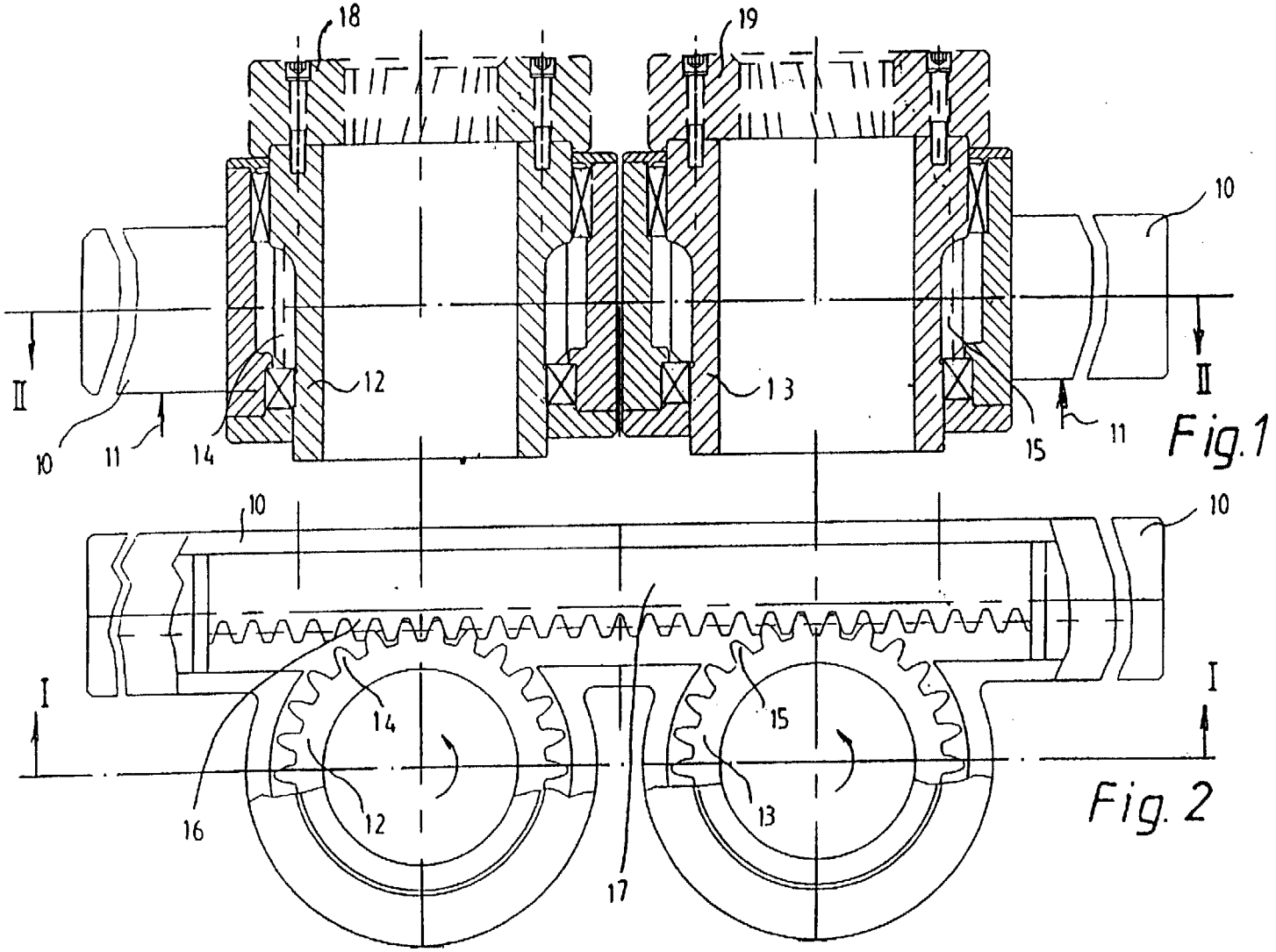
FIG. 1 is a vertical longitudinal section, along line I—I of FIG. 2, showing one embodiment of the cast thimble removal device having a tandem rotation drive.
FIG. 2 is a horizontal section along ling II—II of FIG. 1.

As a first embodiment of the invention, FIGS. 1 and 2 show a device for simultaneously removing two cast thimbles, not illustrated, from anode bar ends of an anode bar in the form of a yoke. The device has a common housing (10), which can be raised by a hydraulic lifting device (11), to the yoke of the anode bar to be processed. The housing (10) of the device is essentially a hydraulic piston-cylinder unit. In the common housing (10), two hollow shafts (12 and 13) are rotatably supported parallel to each other in tandem arrangement in appropriate roller bearings, journal bearings or other suitable bearings. The hollow shaft (12) has external teeth (14) and the hollow shaft (13) has external teeth (15). The external teeth (14 and 15) are engaged by teeth of a toothed rack or rack gear (16) of a double-acting hydraulic piston (17). Upon appropriate pressurization, the hydraulic piston (17) is reciprocated in the hydraulic cylinder formed by the housing (10) and the hollow shafts (12 and 13) are rotatable back and forth.

Clamp ring (18) is rigidly secured by screws to the upper end face of the hollow shaft (12) and a clamp ring (19) is rigidly secured to the upper end face of the hollow shaft (13). by use of the lifting device (11), the clamp rings (18 and 29) are slid from below onto the respective cast thimbles of the anode bars being reprocessed. Upon actuation of the hydraulic piston (17), a torsional moment or torque is exerted on the hollow shafts (12 and 13) and the attached clamp rings (18 and 19). After a positive connection has been formed between radially inward projections of the clamp rings (18, 19) and corresponding projections of the cast thimbles being removed, a torsional moment is transmitted to the cast thimbles and they are simultaneously twisted off with little effort. If the adhesive connection between the cast thimble and the anode bar end is very solid, the hollow shafts (12, 13) together with clamp rings (18, 19) can also be rotated back and forth if necessary to break the adhesive connection.

Figure 3:
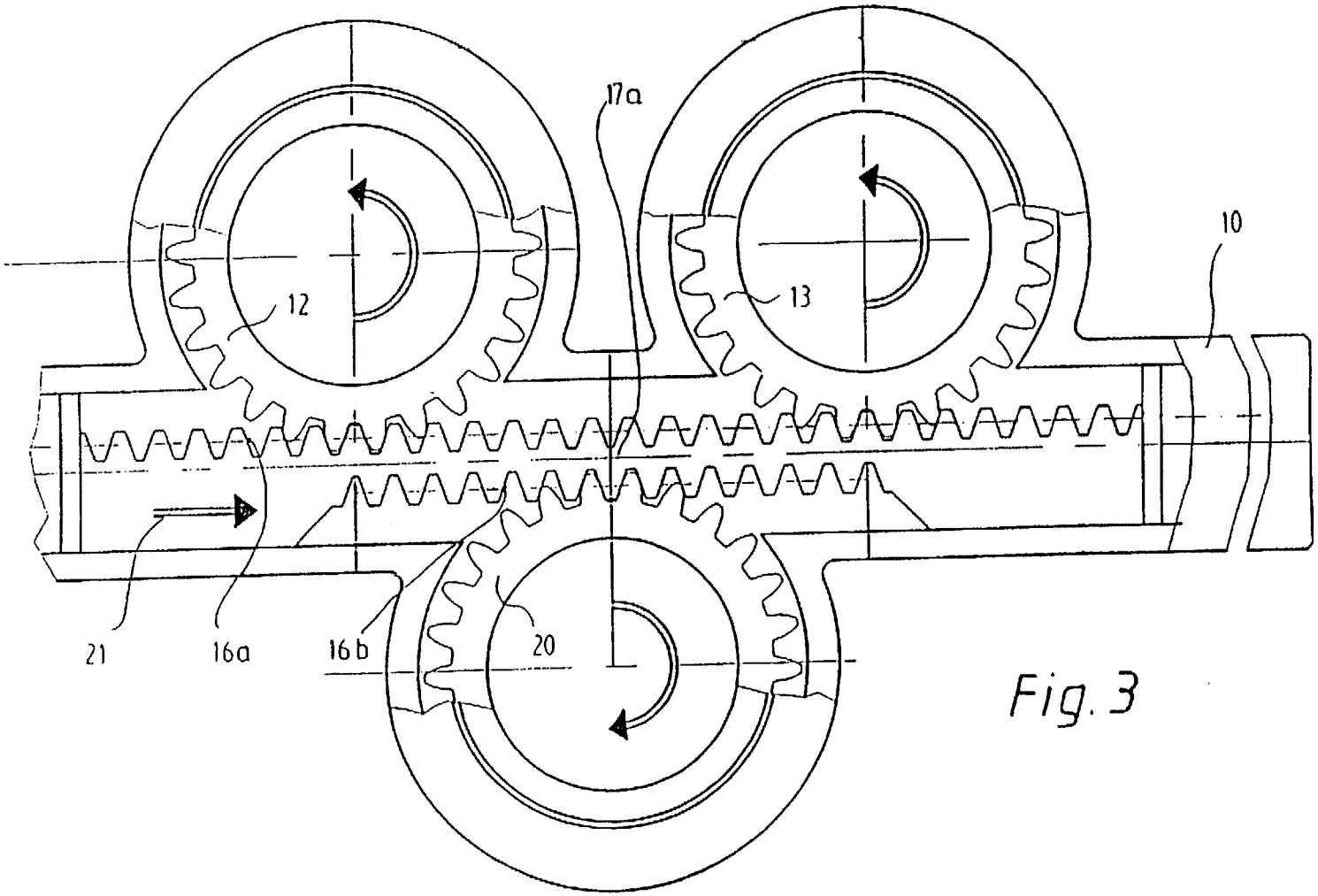
FIG. 3 is a horizontal section of a further embodiment of the invention in which a triple rotary drive is used to simultaneous twist off three cast thimbles from one yoke having anode bar ends forming a triangle and FIG. 4 is a horizontal section of another embodiment of the invention in which two parallel double-acting hydraulic pistons are used for the rotary drive to twist off cast thimbles.

The thimble removing device of FIG. 3 is used to remove thimbles from an anode bar yoke whose end portions have a triangular configuration. In this embodiment, the double-acting hydraulic piston (17*a*) includes a toothed rack or rack gear (16*a*, 16*b*), with teeth on two opposite sides. The toothed rack (16*a*) engages with the external teeth of the hollow shafts (12 and 13) and the toothed rack (16*b*) engages with the external teeth of the opposite hollow shaft (20). If the double-acting hydraulic piston (17*a*) is pressurized to cause it to move in the direction of the arrow (21), the hollow shafts (12 and 13) together with clamp rings are rotated counterclockwise and the hollow shaft (20) together with clamp ring is rotated clockwise. In this way, three cast shells can be twisted off their anode bar ends simultaneously in a very constricted space with relatively little effort.

Figure 4:
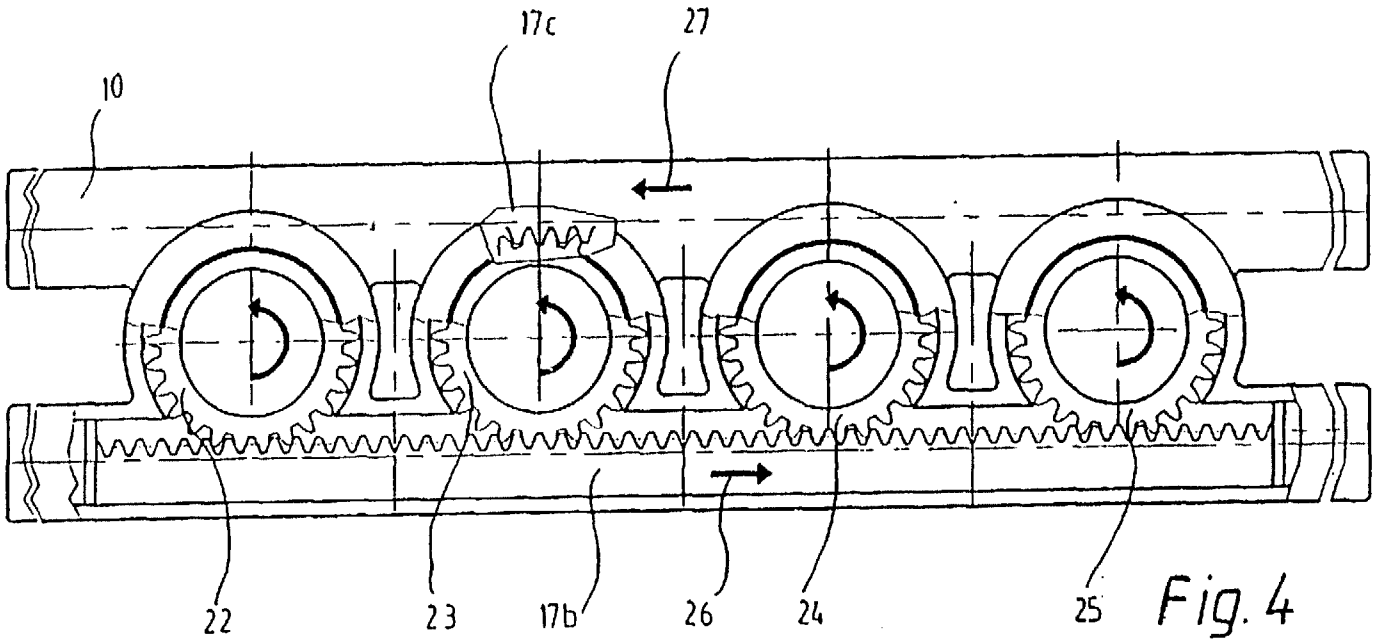

Referring to FIG. 4, two double-acting hydraulic pistons (17*b*, 17*c*) are arranged a distance apart parallel to each other, in a so-called twin arrangement, in the common housing (10), and the two hydraulic pistons (17*b*, 17*c*) include toothed racks whose teeth face or confront each other. The two toothed racks drive four parallel externally toothed hollow shafts (22, 23, 24, 25), which are positioned between the racks. By pressurization of the two twin hydraulic pistons (17*b* and 17*c*) in opposite directions, the externally toothed hollow shafts (22 to 25) together with clamp rings and the cast thimbles being removed are rotated. Thus, if the two hydraulic pistons (17*b* and 17*c*) are actuated in the direction of the arrows 26 and 27, the externally toothed hollow shafts (22 to 25) together with their clamp rings are rotated in a counterclockwise direction and the thimbles are twisted off with a very high torsional moment. For the sake of simplicity, the twin hydraulic pistons (17*b* and 17*c*) are connected to an ordinary hydraulic system having a single hydraulic pump.

The rotation of the externally toothed hollow shafts, together with clamp rings and cast thimbles, could be effected by means of pneumatic cylinders or by means of a spindle drive or worm-gear drive.

The thimble removing device of this invention makes it possible to simultaneously twist off, in a minimum of space and with comparatively slight force effort, a plurality of closely spaced thimbles from the yoke of reprocessed anode bars.

What is claimed is:

1. A device for the forced separation of cast thimbles from the bottom ends of reprocessed anode bars of yoke configuration used in fused-salt electrolysis of aluminum, comprising:

a housing (10);

a lifting device (11) engaging said housing (10);

a first externally toothed hollow shaft (12, 13) rotatably supported in said housing (10), said externally toothed hollow shaft (12, 13) having a clamp ring which is slidable onto said cast thimble upon the raising of said housing by said lifting device (11) and a double acting hydraulic piston (17) in said housing (10) having a toothed rack (16) whose teeth engage the teeth of said rotatable hollow shaft (22, 13), said hollow shaft, clamp ring and cast thimble being adapted for rotation, thereby twisting the cast thimble from said end of said anode bar, upon actuation of said hydraulic piston (17).

2. The device of claim 1, wherein said clamp ring (18, 19) is detachably connected by screws to the upper end face of said rotatably supported hollow shaft (12, 13).

3. The device of claim 1 and further comprising a second externally toothed hollow shaft rotatably supported in said housing in tandem with said first externally toothed hollow shaft, said second externally toothed hollow shaft engaging said toothed rack (16) of said double acting hydraulic piston (17).

4. The device of claim 1 wherein said double-acting hydraulic piston (17*a*) has a toothed rack (16*a*, 16*b*) with teeth on opposite sides thereof, and further comprising a second externally toothed hollow shaft (12, 13, 20), the teeth of said hollow shafts engaging said teeth on said opposite sides of said toothed rack (16*a*, 16*b*).

5. The device of claim 1 wherein two double-acting hydraulic pistons (17*b*, 17*c*) are arranged parallel to each other and a distance apart in twin arrangement in said housing (10), said hydraulic pistons including toothed racks with teeth facing each other and wherein a plurality of parallel externally toothed hollow shafts (22 to 25) are positioned between and engaged by said toothed racks, said twin hydraulic pistons (17*b*, 17*c*) upon actuation in opposite directions being operable to rotate said externally toothed hollow shafts with clam rings together with said cast thimbles.

6. The device of claim 1 wherein said teeth of said externally toothed hollow shaft extend 360° about said hollow shaft.

* * * * *